US006294489B1

(12) United States Patent
Lefort

(10) Patent No.: US 6,294,489 B1
(45) Date of Patent: Sep. 25, 2001

(54) BELT FOR CONVEYING ARTICLES AT HIGH TEMPERATURE

(75) Inventor: Bernard Lefort, Conde sur Noireau (FR)

(73) Assignee: Ferlam Technologies, Sainte Honorine la Chardonne (FR)

( * ) Notice: Subject to any disclaimer, the term of this patent is extended or adjusted under 35 U.S.C. 154(b) by 0 days.

(21) Appl. No.: 09/317,376

(22) Filed: May 24, 1999

(30) Foreign Application Priority Data

May 26, 1998 (EP) ..... 98 490013

(51) Int. Cl.[7] ..... D03D 15/12

(52) U.S. Cl. ..... 442/302; 442/185; 442/198; 442/229; 442/238; 442/246; 442/301

(58) Field of Search ..... 442/302, 185, 442/198, 229, 238, 246, 301

(56) References Cited

U.S. PATENT DOCUMENTS 5,173,361 * 12/1992 Yamashita et al. ..... 428/245
5,399,418 3/1995 Hartmanns et al. .
5,780,152 * 7/1998 Ichiryu et al. ..... 428/257
5,785,621 * 7/1998 Birzele ..... 474/267

FOREIGN PATENT DOCUMENTS 38 43 811 7/1990 (DE) .
WO9607788A1 * 3/1996 (WO) .

OTHER PUBLICATIONS

Abstract. JP 62 199842 (Asahi Sekimen), Sep. 3, 1987.

* cited by examiner

*Primary Examiner*—Terrel Morris
*Assistant Examiner*—Norca L. Torres-Velazquez
(74) *Attorney, Agent, or Firm*—Wolf, Greenfield & Sacks, P. C.

(57) ABSTRACT

The textile conveyor belt of the invention is constituted by at least two layers, namely an outer layer designed to come into contact with articles and an inner layer designed to come into contact with a mechanical conveyor system. Cohesion between the layers is provided by binding threads, the outer layer and the binding threads being made of threads that are made up of an intimate mixture of fibers comprising both stainless steel fibers and fibers of a material selected from those which decompose into carbon when raised to high temperature, e.g. para-aramid or polybenzimidazole. In addition, the inner layer is made of threads having good properties concerning both mechanical strength and resistance to temperature.

6 Claims, 1 Drawing Sheet

BELT FOR CONVEYING ARTICLES AT HIGH TEMPERATURE

The present invention relates to a conveyor belt designed to be mounted in an installation for conveying articles at high temperature, in particular glass articles raised to temperatures that may be as high as 800° C. or 900° C.

BACKGROUND OF THE INVENTION

In the glass-making industry, during the manufacturing process, glass articles taken to temperatures that may be as high as 800° C. or 900° C. are transported by conveyors having textile belts. These conveyor belts, which are tensioned and are supported by wheels, must be capable firstly of withstanding the traction and bending forces inherent to the mechanical conveyor system, and secondly of withstanding the temperature of the glass articles without giving rise to surface defects thereon.

The conveyor belts that are generally implemented are constituted by asbestos fibers having mechanical and thermal characteristic that enable them to fulfill the above conditions in satisfactory manner.

However, asbestos is known to be toxic and its use is now banned. No other fiber has the same mechanical and thermal characteristics as those shown by asbestos. It is therefore not possible to envisage obtaining a textile conveyor belt that satisfies the same specifications as those given above merely by replacing asbestos fibers with some other kind of fiber.

OBJECTS AND SUMMARY OF THE INVENTION

The object of the present Applicant is to provide a textile conveyor belt that is free from asbestos, that is capable simultaneously of withstanding the traction and bending forces inherent to the mechanical conveyor system commonly used, and that is capable of carrying articles at high temperatures without any risk of marking them, in particular articles made of glass.

This object is achieved by the textile conveyor belt of the invention which is constituted by a textile conveyor belt constituted by at least two layers, namely an outer layer designed to come into contact with articles and an inner layer designed to come into contact with a mechanical conveyor system. In a manner characteristic of the invention, cohesion between the layers is provided by binding threads, the outer layer and the binding threads being made of threads that are made up of an intimate mixture of fibers comprising both stainless steel fibers and fibers of a material selected from those which decompose into carbon when raised to high temperature, and the inner layer being made of threads having good properties concerning both mechanical strength and resistance to temperature.

In the special structure of the conveyor belt of the invention, it is the inner layer which serves mainly to provide mechanical strength to the overall conveyor belt, while it is the outer layer which must withstand the very high temperature, at least via the outside face thereof which comes into contact with the articles being conveyed. The stainless steel fibers need to be intimately mixed with other fibers in order to be capable of being spun under acceptable conditions. In addition, the presence, in the outer layer and in the binding layer, of fibers which decompose into carbon when taken to high temperature, makes it possible to have a surface state which, in co-operation with the stainless steel fibers, avoids marking the articles that are raised to high temperature, and in particular articles made of glass. Thus, contact of articles at high temperature with a surface portion of the outer layer and with the binding threads causes the fibers other than the stainless steel fibers to decompose into carbon. This decomposition has the advantage of providing a surface state that does not cause marking and that does not give rise to any unacceptable drawback insofar as the threads in this surface portion, both in the outer layer and the binding threads, are not subjected to significant mechanical forces since these forces are supported mainly by the inner layer of the conveyor belt.

Preferably, the fibers intimately mixed with the stainless steel and that decompose into carbon are para-aramid fibers, in particular those known under the names Kevlar and Twaron or indeed polybenzimidazole fibers known under the names P.B.I., and Zylon.

Preferably, the threads constituting the outer layer and the binding threads are constituted by a mixture comprising 50% to 90% by weight stainless steel fibers and 50% to 10% by weight fibers that decompose into carbon at high temperature.

Preferably, the threads constituting the inner layer are made from para-aramid fibers.

Advantageously, to increase the dimensional stability of the conveyor belt when faced with the mechanical stresses of the conveyor system, the outer layer and the inner layer are reinforced by reinforcement, e.g. the threads constituting one and/or the other layer in the warp direction and in the weft direction of a woven cloth, are reinforced by a continuous metal filament or any other filament having high mechanical strength and resistance to temperature.

In a preferred embodiment, the conveyor belt of the invention is obtained by multi-ply weaving comprising at least two plies corresponding respectively to the outer layer and to the inner layer.

In this embodiment, the conveyor belt preferably comprises four plies, two outer plies being constituted, as are the binding threads, by an intimate mixture of stainless steel fibers and of aramid fibers, while the third and fourth plies are made of threads obtained from aramid fibers.

Preferably, in this configuration, the four plies are reinforced in warp and in weft by a continuous reinforcing filament which is either made of metal or of a material that has high mechanical strength and good resistance to temperature.

BRIEF DESCRIPTION OF THE DRAWING

The present invention will be better understood on reading the following description of a preferred embodiment of a four-ply conveyor belt for articles at high temperature as shown in the accompanying drawing, where the sole FIGURE is a highly diagrammatic representation in longitudinal section through said belt.

MORE DETAILED DESCRIPTION

Figure 1:
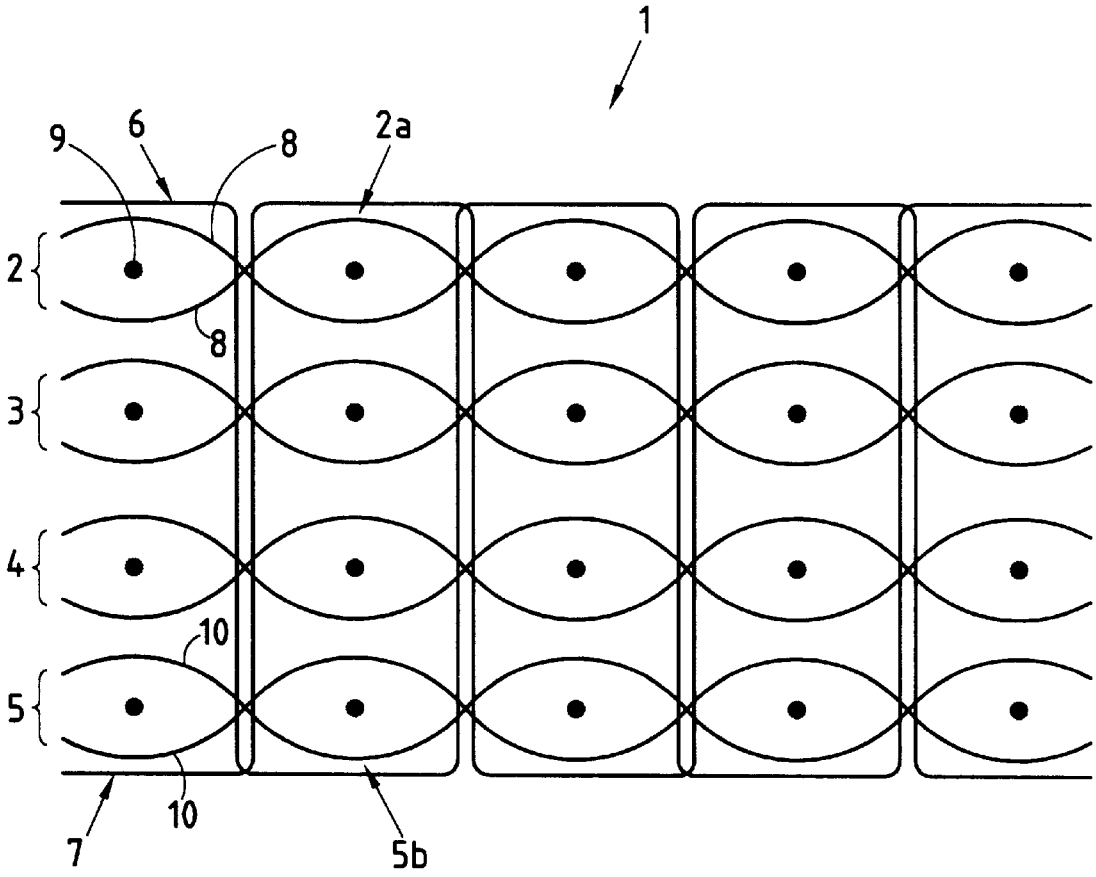

The conveyor belt 1 is a textile strip obtained by the conventional technique of multiply weaving. It comprises four successive plies 2, 3, 4, and 5 (i.e. four superposed layers of cloth) and cohesion between them is provided by means of binding threads 6, 7. Each ply 2, 3, 4, 5 is made up of warp threads 8 and weft threads 9. The superposition of four plies is locked by the binding threads which pass in alternation from the top face 2*a* of the first ply 1 to the bottom face 5*b* of the fourth ply 5. The binding threads 6, 7 pass through zones that are situated between successive weft threads 9.

As shown in the FIGURE, the textile strip 1 is entirely symmetrical in structure from one face to the other. However in the intended application of the invention, i.e. to a conveyor belt for articles at high temperature, the composition of the various plies and of the binding threads can differ depending on whether the plies are designed to face towards the mechanical conveyor system or whether they are designed to support the articles at high temperature.

More precisely, the articles at high temperature are designed to come into contact with the top face 2*a* of the first ply 2, while the bottom face 5*b* of the fourth ply 5 is designed to come into contact with the wheels for tensioning and driving the conveyor system.

Under such conditions, the warp threads 8 constituting the first ply are threads obtained from an intimate mixture of stainless steel fibers and para-aramid fibers, with the mixture comprising 70% by weight 12 micron 316L stainless steel fibers and 30% by weight Kelvar or Twaron type para-aramid fibers. The weft fibers 9 constituting the first ply are also obtained from an intimate mixture of stainless steel fibers and para-aramid fibers so that no thread appears on the surface of the strip 9 that does not contain stainless steel.

The warp threads and the weft threads of the fourth ply 5 are made of fibers obtained from para-aramid fibers of the Kevlar type.

The binding fibers 6, 7 are obtained from an intimate mixture of stainless steel fibers and of Kevlar type para-aramid fibers comprising 50% to 90% stainless steel fibers and 50% to 10% Kevlar fibers.

In a particular embodiment, the second ply 3 has the same composition as the first ply 2, while the third ply 4 has the same composition as the fourth ply 5.

It is the surface portion of the first ply 2 and the binding threads 6, 7 that appear on the surface 2*a* of the first ply 1 that come into contact with the articles at high temperature and which need to have the greatest resistance to temperature. The para-aramid fibers which make it possible to obtain acceptable spinning of the stainless steel fibers when in intimate mixture therewith, have the characteristic of decomposing into the form of carbon at temperatures of about 800° C. to 900° C. This decomposition is not objectionable, and indeed is advantageous since it gives a surface state to the surface portion of the conveyor belt 1 that ensures that no marking occurs on the articles at high temperature, and in particular articles made of glass. This decomposition which can give rise to a certain loss of mechanical strength is of no consequence from this point of view since the mechanical strength of the conveyor belt 1 is obtained mainly from the third and fourth plies which are made of threads constituted by para-aramid fibers, that are well known for their very high mechanical strength.

The present invention is not limited to the preferred embodiment described above by way of non-exhaustive example. In particular, it is possible to use fibers other than para-aramid fibers for constituting the outer layer, i.e. the first ply, and in particular it is possible to use polybenzimidazole fibers, which, decompose like polyaramid fibers into carbon when they are raised to high temperature.

It will be understood that the further the inner layer is located from the outer layer, the smaller the temperature resistance properties that are required of said inner layer. In the example shown above, the inner layer is constituted by the fourth ply 5 and it is thermally insulated by the stack of the other three plies 2, 3, 4.

Where necessary, it is possible to increase the dimensional stability of the belt by reinforcing it by means of reinforcement. For example, the warp and weft threads constituting all or some of the layers can be reinforced by continuous metal filaments or other filaments that represent high mechanical strength and high resistance to temperature.

In the above-described example, the composition of the third and fourth plies constituting the inner layer differs from the composition of the first and second plies constituting the outer layer. This solution provides a significant advantage concerning cost price, because of the higher cost of stainless steel fibers. Nevertheless, there is nothing technically to prevent threads being used for the inner layer that are made of an intimate mixture of stainless steel fibers and of para-aramid fibers. The advantage could lie in particular in manufacturing a belt that is entirely symmetrical as to structure and as to composition, i.e. a belt that does not have a front face and a back face.

What is claimed is:

1. A textile conveyor belt comprising:

an outer layer entirely formed only of an intimate mixture of stainless steel fibers and fibers of a material selected from those which decompose into carbon when raised to a high temperature;

an inner layer comprising threads which are different from the threads of the outer layer and which have good mechanical strength and resistance to temperature; and binding threads providing cohesion between the inner and outer layers and being made of threads comprising an intimate mixture of fibers comprising both stainless steel fibers and fibers of a material selected from those which decompose into carbon when raised to a high temperature.

2. The conveyor belt according to claim 1, wherein the inner layer is formed only from para-aramid fibers.

3. The conveyor belt according to claim 1, wherein the fibers in the outer layer that decompose into carbon are para-aramid fibers.

4. The conveyor belt according to claim 1, wherein the threads comprising the outer layer and the binding threads are formed of a mixture comprising about 50% to 90% by weight of stainless steel fibers and about 50% to 10% by weight of fibers that decompose into carbon at high temperature.

5. A textile conveyor belt formed by a multi-ply weaving comprising:

an outer layer comprising two plies formed entirely of only an intimate mixture of stainless steel fibers and fibers which decompose into carbon when raised to a high temperature;

an inner layer comprising a third ply and a fourth ply, the third and fourth plies being formed of threads obtained from aramid fibers which are different from the threads of the outer layer and which have good mechanical strength and resistance to temperature; and binding threads providing cohesion between the inner and outer layers and comprising an intimate mixture of stainless steel fibers and fibers which decompose into carbon when raised to a high temperature.

6. The conveyor belt according to claim 5, wherein the third and fourth plies are formed only of aramid fibers.

* * * * *